United States Patent [19]

Locker

[11] 3,989,527

[45] Nov. 2, 1976

[54] SILVER HALIDE PHOTOGRAPHIC ELEMENT CONTAINING BLENDED GRAINS

[75] Inventor: David J. Locker, Rochester, N.Y.

[73] Assignee: Eastman Kodak Company, Rochester, N.Y.

[22] Filed: Jan. 8, 1975

[21] Appl. No.: 539,476

[52] U.S. Cl. ..... 96/69; 96/94 R; 96/98; 96/121

[51] Int. Cl.[2] ..... G03C 1/76; G03C 1/02

[58] Field of Search ..... 96/121, 69, 98, 94 R

[56] References Cited

UNITED STATES PATENTS

| | | | |
|---|---|---|---|
| 2,202,026 | 5/1940 | Renwick | 96/121 |
| 2,620,272 | 12/1952 | Schwarz | 96/121 |
| 3,206,313 | 9/1965 | Porter et al. | 96/121 |
| 3,600,180 | 8/1971 | Judd et al. | 96/98 |
| 3,628,960 | 12/1971 | Phillippaerts et al. | 96/94 R |
| 3,655,394 | 4/1972 | Illingsworth | 96/94 R |

OTHER PUBLICATIONS

Harvey, Def. Pub. T877,010, Published Aug. 18, 1970.

*Primary Examiner*—J. Travis Brown
*Attorney, Agent, or Firm*—Carl O. Thomas

[57] ABSTRACT

A photographic element is disclosed comprised of a support and, coated on the support, at least one radiation-sensitive layer. The radiation-sensitive layer contains silver halide grains including a spectral sensitizer adsorbed on the surface thereof and, intimately admixed therewith, silver halide grains free of surface spectral sensitization and having a particle size in the range of 0.15 to 0.8 micron in diameter. The photographic element exhibits improved speed without a concurrent increase in graininess.

9 Claims, No Drawings

SILVER HALIDE PHOTOGRAPHIC ELEMENT CONTAINING BLENDED GRAINS

The present invention relates to novel silver halide photographic elements. More specifically, the invention relates to such photographic elements including at least one layer of a photographic silver halide emulsion which has been blended to improve photographic speed.

As is well understood by those skilled in the photographic arts, silver halides possess a native sensitivity to the shorter wavelengths of the visible spectrum. To obtain photographic response to other portions of the visible spectrum it is common practice to associate a spectral sensitizer with the silver halide grains. Typically the spectral sensitizer takes the form of a dye adsorbed to the surface of the silver halide grains and capable of absorbing electromagnetic radiation of the wavelength desired to be photographically recorded. The dye transfers this energy to the silver halide grains so that they form a latent image. In the absence of spectral sensitization, silver halide grains are not photographically responsive in the green and red portions of the visible spectrum.

Another recognized characteristic of photographic silver halides is that faster photographic speeds are obtainable as the size of the silver halide grains increase. In an effort to improve the speed of photographic elements, larger silver halide grains have been employed. Unfortunately, larger silver halide grains can produce undesirable graininess in the photographic image. Acceptable image graininess then, limits the size of silver halide grains employed in many photographic products which in turn limits their photographic speeds.

I have discovered quite unexpectedly that photograhic elements responsive to longer electromagnetic radiation wavelengths (e.g., orthochromatic, panchromatic and infrared responsive elements) of enhanced photographic speed and without concomitant increase in graininess can be obtained by blending with the spectrally sensitized silver halide grains in at least one layer of the photographic element silver halide grains that are free of surface spectral sensitization and that are chosen to have a grain size of from 0.15 to 0.8 micron in diameter. This is quite surprising, first because the grains that are free of surface spectral sensitization enhance the speed of the photographic element even when it is exposed to only green and/or red light. Second, the silver halide grains contribute to improved photographic speed even when they are well below the mean grain diameter of the spectrally sensitized silver halide grains.

It is my belief that the spectrally unsensitized silver halide grains improve photographic speed by causing more electromagnetic radiation reaching the photographic element on imagewise exposure to impact upon the surface of the spectrally sensitized silver halide grains. The spectrally unsensitized silver halide grains are believed to perform this function first because being free of spectral sensitization they are comparatively inefficient in absorbing electromagnetic radiation outside the range of native spectral sensitivity. However, mere inability to absorb radiation does not in itself indicate that the silver halide grains will deflect or scatter radiation. I have observed most efficient scattering of electromagnetic radiation to be obtained within the size range of from 0.15 to 0.8 micron in diameter. It is my recognition then that by properly choosing the size of silver halide grains and by retaining these grains free of surface spectral sensitization they will scatter incident radiation so that the spectrally sensitized silver halide grains with which they are blended receive a greater effective exposure and therefore exhibit enhanced photographic speed.

Marriage British Pat. No. 504,283 teaches the formation of photographic elements in which the photographic image appears of greater density by reason of being held in a layer formed by a diffusing medium containing a pigment. The pigment is chosen to have a high refractive index so that it scatters light passing through the layer. The size of the pigment particles are disclosed to be not greater than the average size of the light sensitive particles, e.g. silver halide particles, used for image formation. Pigment particle sizes of about 1 micron are disclosed in Examples 2 through 4. There is no disclosure of any pigment particle sizes below 1 micron nor any suggestion that an advantage would be achieved by such a size choice. There is no indication that the pigment particles could be replaced with silver halide particles. There is no teaching to sensitize spectrally the surface of the silver halide particles.

Fugi British Pat. No. 1,342,687 teaches the formation of photographic elements capable of forming sharper photographic images through reduced light scattering. This is accomplished by blending with a silver halide emulsion of ordinary grain size distribution (0.3 to 3 microns) a superfine silver halide emulsion having mean silver halide particle sizes below 0.2 micron. The superfine silver halide particles are said not to scatter light (although this is strictly true in the limiting case where the mean particle sizes approach 0.2 micron only in those instances where longer wavelength radiation is employed and the maximum size of the particles present is curtailed). The superfine silver halide grains reduce light scattering by modifying the refraction index of the silver halide emulsion layer of the photographic element and thereby reducing halation. Both the ordinary and superfine silver halide grains are sensitized identically in the working examples. Both are optically sensitized.

Porter et al U.S. Pat. Nos. 3,206,313 and 3,317,322, issued Sept. 14, 1965 and May 2, 1967, respectively, teach the formation of covered grain emulsions. To form a covered grain emulsion a core emulsion is provided which can be any conventional surface sensitive emulsion. The surface of the core grains is typically chemically sensitized and, in some applications, can be spectrally sensitized. A finer grained silver halide emulsion referred to as a shell emulsion is then blended with the core emulsion and Ostwald ripening allowed to occur. During ripening the smaller grains of the shell emulsion dissolve and the silver halide precipitates onto the surface of the core grains. In this way composite silver halide grains are produced having a core and shell structure. Porter et al teach the size of the shell grains to be not greater than 0.4 micron and, preferably, not greater than 0.1 micron.

While Porter et al are concerned with forming photographic elements from the covered grain emulsions that are produced rather than the initial composite of core and shell emulsions from which they are formed, Porter et al report photographic comparisons of the composite starting emulsion and the final covered grain emulsion. In Porter et al '313 a very fine grain shell emulsion is blended with a chemically sensitized larger grain emulsion to form a covered grain emulsion. When the core and shell emulsions are freshly blended the composite emulsion shows conventional behavior, high surface speed and fog. In Porter et al. '322 this same comparison is reported in Example 2. In neither patent do the initial composite emulsions photographically examined contain spectrally sensitized silver halide grains nor is there any recitation of the shell emulsion grain size from which the reflective behavior of these grains can be judged. While Porter et al in producing some embodiments disclosed could prepare some of the silver halide emulsions useful in the practice of my invention as starting materials for the formation of covered grain emulsions, there is no disclosure by Porter et al of any photographic elements incorporating any of the silver halide emulsions of my invention.

Godowsky et al U.S. Pat. No. 3,152,907, issued Oct. 13, 1964, teach the improvement of speed and contrast in a silver halide emulsion containing spectrally sensitized silver halide grains and silver chloride grains free of surface optical sensitization. While the mechanism by which the silver chloride grains enhance photographic performance is not stated, it is apparent that Godowsky et al do not rely upon the silver chloride grains to reflect light to the spectrally sensitized silver halide grains. Godowsky et al clearly show that the advantageous increase in image developability achieved is independent of the location of the unsensitized silver chloride grains in the emulsion. For example, the silver chloride grains are effective both when incorporated in the coupler packets and when distributed in the vehicle separating the packets. Godowsky et al observe, however, that the composition of the unsensitized silver chloride grains are critical to the practive of the invention. For example, Godowsky et al. state that silver chlorobromides in which the ratio of chloride to bromide is 2:98 or 10:90 show too little effect on speed and contrast to be useful. Godowsky et al. contain no indication of either the size or distribution of the silver chloride grains being of any importance. The patent is silent with regard to the use of monodispersed silver chloride grains and contain no mention of any numerical range of grain sizes.

In one aspect, my invention is directed to a photographic element comprising a support and, coated thereon, a radiation-sensitive layer containing spectrally sensitized silver halide grains. Intimately admixed with the spectrally sensitized silver halide grains are silver halide grains free of surface spectral sensitization and having a particle size in the range of 0.15 to 0.8 micron in diameter.

In the practice of my invention I employ an intimate intermixture of two distinct silver halide grain populations. For latent image formation I employ spectrally sensitized silver halide grains of any convenient conventional form, Intimately intermixed with the spectrally sensitized silver halide grains is a second silver halide grain population, hereinafter referred to as reflecting silver halide grains or simply reflecting grains. Useful results can be obtained in the practice of my invention with widely varying proportions of the two grain populations. It is contemplated that, on a weight basis, the spectrally sensitized grains can account for anywhere from 1 to 99 percent of the total silver halide grains, preferably 10 to 90 percent of the total silver halide grains. The reflecting silver halide grains can account for the balance. To achieve the advantages of my invention at least 1 percent of the silver halide grains, on a weight basis, are reflecting grains, preferably at least 10 percent. Other silver halide grains can also be present, such as, silver halide grains which are free of spectral sensitization and which are outside the size range required to serve as reflecting grains.

The spectrally sensitized silver halide grains can comprise silver chloride, silver bromide, silver bromoiodide, silver chlorobromide, silver chloroiodide, silver chlorobromoiodide crystals or mixtures thereof. The spectrally sensitized silver halide grains can be coarse, fine or any combination or gradation of silver halide grain sizes, but are preferably larger in size than the reflecting silver halide grains. The silver halide grains can be prepared by any convenient conventional technique, such as, by single jet precipitation techniques described in Trivelli and Smith *The Photographic Journal*, Vol. LXXIX, May, 1939 (pp. 330–338), by double jet precipitation techniques such as those employed to form Lippman emulsions, by techniques used to form ammoniacal silver halide emulsions, or by techniques used to form thiocyanate or thioether ripened silver halide emulsions such as those described in Nietz et al U.S. Pat. No. 2,222,264, issued Nov. 19, 1940; Illingsworth U.S. Pat. No. 3,320,069, issued May 16, 1967 and McBride U.S. Pat. No. 3,271,157, issued Sept. 6, 1966.

The spectrally sensitized silver halide grains can form latent images predominantly on the surface of the silver halide grains, or predominantly on the interior of the silver halide grains as described in Davey et al U.S. Pat. No. 2,592,250, issued May 8, 1952; Porter et al. U.S. Pat. No. 3,206,313, issued Sept. 14, 1965; Berriman U.S. Pat. No. 3,367,778, issued Feb. 6, 1968 and Bacon et al. U.S. Pat. No. 3,447,927, issued June 3, 1969. The spectrally sensitized silver halide grains can be either regular or irregular in shape. The spectrally sensitized silver halide grains can be of a type which allow negative image formation or positive image formation as described in Leermakers U.S. Pat. No. 2,184,013, issued Dec. 19, 1939; Kendall et al U.S. Pat. No. 2,541,472, issued Feb. 13, 1951; Schouwenaars British Pat. No. 723,019, issued Feb. 2, 1955; Illingsworth et al French Pat. No. 1,520,821, isued Mar. 4, 1968; Illingsworth U.S. Pat. No. 3,501,307, issued Mar. 17, 1970; Ives U.S. Pat. No. 2,563,785, issued Aug. 7, 1951; Knott et al. U.S. Pat. No. 2,456,953, issued Dec. 21, 1948; Land U.S. Pat. No. 2,861,885, issued Nov. 25, 1958; and Evans U.S. Pat. No. 3,761,276, issued Sept. 25. 1973.

The spectrally sensitized silver halide grains employed in the practice of my invention are characterized in being rendered photographically responsive to a broader portion of the visible electromagnetic spectrum than is exhibited by silver halide grains of native sensitivity. This can be accomplished by employing any convenient conventional approach to spectral sensitization. Spectral sensitizing dyes are preferably employed to confer additional sensitivity to these silver halide grains. These silver halide grains are spectrally sensitized prior to admixture with the second silver halide grain population. Additional spectral sensitization can be obtained by treating the spectrally sensitized silver halide grains with a solution of a sensitizing dye in an organic solvent. Alternately the dye can be added to the spectrally sensitized silver halide grains in the form of a dispersion as described in Owens et al British Pat. No. 1,154,781, published June 11, 1969.

Sensitizing dyes useful in sensitizing silver halide grains are described, for example, in Brooker et al U.S. Pats. Nos. 2,095,854 and 2,095,856, issued Oct. 12, 1937; Brooker et al. U.S. Pat. No. 2,493,748, issued Jan. 10, 1950; Sprague U.S. Pat. No. 2,503,776, issued Apr. 11, 1950; Brooker et al. U.S. Pat. No. 2,526,632, issued Oct. 24, 1950; Heseltine U.S. Pat. No. 2,734,900, issued Feb. 14, 1956; Taber et al. U.S. Pat. No. 3,384,486, issued May 21, 1968; Heseltine U.S. Pat. No. 3,582,344, issued June 1, 1971; and Fumia et al U.S. Pat. No. 3,652,288, issued Mar. 28, 1972. Spectral sensitizers which can be used include the cyanines, merocyanines, complex (tri- or tetranuclear) cyanines, homopolar cyanines, styryls, hemicyanines (e.g., enamine hemicyanines), oxonols and hemioxonols.

Dyes of the cyanine classes suitable for sensitizing silver halide can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups and can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei mentioned above as well as acid nuclei such as thiohydantoins, rhodanines, oxazolidenediones, thiazolidenediones, barbituric acids, thiazolineones, and malononitrile. These acid nuclei can be appropriately substituted with alkyl, alkylene, phenyl, carboxyalkyl, sulfoalkyl, hydroxyalkyl, alkoxyalkyl, alkylamino groups, or heterocyclic nuclei. Combinations of these dyes can be used, if desired. In addition, super-sensitizing addenda which do not absorb visible light can be included, for instance, ascorbic acid derivatives, azaindenes, cadmium salts, and organic sulfonic acids as described in McFall et al. U.S. Pat. No. 2,933,390, issued Apr. 19, 1960; and Jones et al U.S. Pat. No. 2,937,089, issued May 17, 1960.

Intimately intermixed with the spectrally sensitized silver halide grains is a second silver halide grain population formed by reflecting silver halide grains having as their function to increase photographic speed through the reflection or deflection of radiation impinging upon the reflecting grains so that at least a portion of the reflected or deflected radiation reaches the spectrally sensitized grains. In order to be effective in performing this function it is essential that the reflecting grains be free of surface spectral sensitization. In this way, radiation absorption is limited to the spectral region of native sensitivity with actinic radiation beyond the region of native sensitivity being deflected or scattered to the spectrally sensitized grains. Of course, where exposure is undertaken using radiation entirely outside the region of native sensitivity, the reflecting grains absorb little, if any, radiation.

The reflecting silver halide grains effective for deflecting visible light are characterized by grain diameters in the range of from 0.2 to 0.6 micron. This grain size distribution is important, since I have observed a relationship to exist between grain size and the efficiency of the grains in scattering radiation within the visible spectrum. Generally silver halide grains having a diameter of 0.2 micron are most effective in scattering 400 nm wavelength light while silver halide grains having a diameter of 0.6 micron are most effective in scattering 700 nm light. For scattering light of wavelengths distributed within the visible spectrum, it is preferred to employ reflecting silver halide grains that vary in grain size from 0.2 to 0.6 micron in diameter. Where it is desired to scatter radiation in the near ultraviolet and the near infrared as well as the visible region of the spectrum, the diameters of the scattering grains can range from 0.15 to 0.8 micron in diameter. It is contemplated that additional silver halide grains free of spectral sensitization which are larger and/or smaller in diameter than the scattering grains can also be present in my novel photographic elements. These grains do not detract from the performance of my photographic elements even though they are not effective in scattering imaging radiation. In most instances, it is preferred that at least 30% by weight of the silver halide grains free of surface sensitization exhibit a diameter effective to produce scattering of actinic radiation.

In one preferred form of my invention, the reflecting silver halide grains are monodispersed grains having a mean diameter falling within the range of from 0.15 to 0.8, most preferably 0.2 to 0.6 micron. Monodispersed silver halide grains are defined for purposes of this invention as those which have no more than about 5%, by weight, of the silver halide grains smaller than the mean grain size and/or no more than about 5%, by number, of the silver halide grains larger than the mean grain size, vary in diameter from the mean grain diameter by more than 40%. It is preferred that at least 95%, by weight, of the monodispersed reflecting grains have a diameter which is within 40%, most preferably within 30%, of the mean grain diameter. Only the silver halide grains that are free of surface spectral sensitization are included in considering the distribution of the reflecting silver halide grains.

Subject to the size considerations indicated above, the reflective silver halide grains can take any conventional form. Preferred reflective silver halide grains are silver chloride, silver bromide, silver chlorobromide and silver bromoiodide grains. The grains can be formed by any of the techniques described above for producing the imaging grains. It is generally most convenient to form monodispersed reflective silver halide grains by double jet precipitation techniques. However, grains of the desired size characteristics can be separated from polydispersed silver halide grain populations using conventional grain separation procedures, such as hydrocyclone fractional separation described in U.S. Pat. No. 3,326,641, issued June 20, 1967.

A preferred approach for producing a mixture of spectrally sensitized and reflecting silver halide grains according to the present invention is first to form separately the two grain populations using conventional silver halide preparation techniques. Either or both of the silver halide grain populations can be chemically sensitized employing conventional techniques, such as disclosed in *Product Licensing Index*, Vol. 92, December 1971, publication 9232, paragraph III. Before blending the two grain populations the silver halide grains intended to form the photographic latent image are spectrally sensitized as indicated above. Before or after blending, additional conventional photographic addenda can be incorporated. Such addenda include antifoggants and stabilizers, hardeners, pasticizers and lubricants, coating aids, brighteners, color forming materials such as couplers and image processing components such as developing agents and components to allow dry processing. Such addenda are disclosed in *Product Licensing Index*, cited above.

Although not essential to the practice of my invention, the separate silver halide grain populations are preferably prepared in the form of silver halide emulsions and blended using conventional photographic emulsion blending techniques. The emulsions can contain various colloids alone or in combination as vehicles. Suitable hydrophilic vehicle materials include both naturally occurring substances such as proteins, for example, gelatin, gelatin derivatives, cellulose derivatives, polysaccharides such as dextran, gum arabic and the like; and synthetic polymeric substances such as water soluble polyvinyl compounds like poly(vinylpyrrolidone), acylamide polymers and the like. The vehicles can also contain alone or in combination with hydrophilic, water-permeable colloids, other synthetic polymers compounds such as dispersed vinyl compounds such as in latex form and particularly those which increase the dimensional stability of the photographic materials. Typical synthetic polymers include those described in Nottorf U.S. Pat. No. 3,142,568, issued July 28, 1964; White U.S. Pat. No. 3,193,386, issued July 6, 1965; Houck et al. U.S. Pat. No. 3,062,674, issued Nov. 6, 1962; Houck et al. U.S. Pat. No. 3,220,844, issued Nov. 30, 1965; Ream et al. U.S. Pat. No. 3,287,289, issued Nov. 22, 1966; and Dykstra U.S. Pat. No. 3,411,911, issued Nov. 19, 1968. Other vehicle materials include those water-insoluble polymers of alkyl acrylates and methacrylates, acrylic acid, sulfoalkyl acrylates or methacrylates, those which have crosslinking sites which facilitate hardening or curing as described in Smith U.S. Pat. No. 3,488,708. issued Jan. 6, 1970, and those having recurring sulfobetaine units as described in Dykstra Canadian Pat. No. 774,054.

The intimately blended silver halide grains together with such other addenda and vehicles, if any, as may be present, can be coated on a photographic support to form one or more radiation-sensitive layers. Exemplary conventional photographic supports are disclosed in *Product Licensing Index*, cited above, paragraph X. The radiation-sensitive layer or layers can be present in combination with one or more conventional subbing layers, interlayers, overcoats and the like.

The resulting photographic elements are panchromatic or orthochromatic. The photographic elements can take the form of radiographic elements, direct-positive elements, negative image-forming elements, thermally processable elements, image transfer elements, multilayer multi-color elements, high contrast elements and the like.

The photographic elements formed according to the practice of my invention are characterized as exhibiting a high ratio of photographic speed to image graininess. In a preferred form my photographic elements are of comparatively high speed. To achieve higher speed I employ spectrally sensitized silver halide grains which are significantly larger in diameter than the reflecting grains. For high speed photographic elements, I prefer to employ imaging grains having a mean diameter greater than at least 0.8 micron, most preferably greater than 1.0 micron. Spectrally sensitized grain mean diameters of from 2 to 4 times those of the reflecting silver halide grains are contemplated for higher speed photographic elements.

The photographic elements of my invention can be processed by any convenient conventional technique. Illustrative processing techniques are disclosed in *Product Licensing Index*, cited above, paragraph XXIII. A particular advantage in employing reflecting silver halide grains as opposed to pigment or other reflecting grains is that silver halides are compatible with the spectrally sensitized grains and with the other photographic addenda present. Thus, the risk of desensitization or unwanted side reactions is minimized. At the same time, the reflecting silver halide grains can be removed during photographic processing, such as during fixing. Since the reflecting grains can be readily removed, they need form no part of the final image. By comparison, incorporated pigments employed for reflecting can significantly increase the background density of the photographic image and thereby reduce contrast and tone down image highlights. Further, other reflecting grains may not be readily removable from the photographic element without resort to specially adapted processing techniques.

My invention can be better appreciated by reference to the following comparison of a specific preferred embodiment of my invention with a similar photographic element lacking reflecting grains in the emulsion coating:

EMULSION A

A silver bromoiodide emulsion (6 mole % iodide) was prepared by adding simultaneously an aqueous silver nitrate solution and an aqueous potassium bromide and potassium iodide solution to a phthalated bone gelatin solution containing 17.5 g of sodium thiocyanate/silver mole. The total run time of precipitation was 80 minutes and the temperature was maintained at 78° C. The emulsion was then coagulation washed as described in Yutzy U.S. Pat. No. 2,614,928. The resulting grains have a diameter ranging 0.24 to 2.0 micron with a mean diameter of 0.92 micron. The emulsion was chemically sensitized to optimum using the chemical sensitizers sodium thiosulfate and potassium chloroaurate and spectrally sensitized to green light using the following green spectral sensitizing dyes: 116 mg of 3,3′,9-triethyl-5,5′-diphenyloxacarbocyanine bromide per silver mole and 38 mg of anhydro-5,5′,6,6′-tetrachloro-1,1′,3-triethyl-3′-(3-sulfobutyl)-benzimidazolocarbocyanine hydroxide per silver mole.

EMULSION B

A monodispersed fine grain cubic silver bromide emulsion was prepared by a normal double jet technique while maintaining the pAg at 8.5 and the temperature of 70° C throughout the 48 minute precipitation. The emulsion was coagulation washed using the procedure described in Emulsion A. The resulting grains have an edge length of 0.48 micron with grains ranging in size from 0.47 to 0.49 micron in diameter. The emulsion was not chemically or optically sensitized and, therefore, relatively light insensitive compared to Emulsion A.

Emulsion B was added to Emulsion A and the mixed emulsion sample was coated with the magenta coupler described as coupler 7 in U.S. Pat. No. 2,600,788 on a film support at the silver coverages indicated in the following table. The coated sample and a control were identically exposed and developed according to process B described in Example 1 of U.S. Pat. No. 3,189,452. The following results were observed:

TABLE I

| Emulsion A ($mg/dm^2$) | Emulsion B ($mg/dm^2$) | Relative Speed | γ Contrast) | Dmax | Dmin |
|---|---|---|---|---|---|
| 15.0 | none | 100 | 0.47 | 0.94 | 0.26 |
| 15.0 | 5.0 | 138 | 0.52 | 1.00 | 0.26 |

From Table I it is apparent that a 38 percent increase in speed was obtained by adding the silver halide reflecting grains to the coating containing the silver halide imaging grains. Contrast and maximum density were increased slightly while minimum density was unaffected by addition of the reflecting silver halide grains. This illustrates that the reflecting grains provide a significant photographic improvement. Since the reflecting grains are small as compared to the spectrally sensitized grains, the graininess of the resulting photographic image was not increased.

The invention has been defined in detail with particular reference to certain preferred embodiments thereof, but it will be understood that variations and modifications can be effected within the spirit and scope of the invention.

I claim:

1. A photographic element comprising a support and, coated thereon, a radiation-sensitive layer containing silver halide grains having a mean particle size greater than about 0.9 micron in diameter and having 3,3′,9-triethyl-5,5′-diphenyloxacarbocyanine bromide and anhydro-5,5′,-6,6′-tetrachloro-1,1′,3-triethyl-3′-(3-sulfobutyl)-benzimidazolocarbocyanine hydroxide as spectral sensitizers adsorbed on the surface thereof and intimately admixed therewith reflecting silver halide grains free of surface spectral sensitization and having a particle size greater than 0.40 micron and less than 0.60 micron in diameter, which, upon exposure, cause electromagnetic radiation to impact upon the surface of the spectrally sensitized silver halide grains.

2. A photographic element according to claim 1 wherein said reflecting silver halide grains free of surface spectral sensitization are monodispersed silver halide grains.

3. A photographic element according to claim 1 wherein said spectrally sensitized silver halide grains are comprised of silver bromide.

4. A photographic element according to claim 1 wherein said spectrally sensitized silver halide grains are silver bromoiodide grains.

5. A photographic element according to claim 1 wherein said reflecting silver halide grains free of surface spectral sensitization are silver bromide grains.

6. A photographic element according to claim 5 wherein said reflecting silver halide grains free of surface spectral sensitization are silver bromoiodide grains.

7. A photographic element according to claim 1 wherein said silver halide grains free of surface spectral sensitization and said silver halide grains which are spectrally sensitized are each present within the range of from 1 to 99 percent, by weight, based on the total weight of silver halide.

8. A photographic element according to claim 7 wherein said reflecting silver halide grains free of surface spectral sensitization and said silver halide grains which are spectrally sensitized are each present within the range of from 10 to 90 percent, by weight, based on the total weight of silver halide.

9. A photographic element comprising a support and, coated thereon, a radiation-sensitive layer containing from 10 to 90 percent, by weight, based on total silver halide present, of silver bromoiodide grains having a mean particle size greater than about 0.9 micron in diameter and having 3,3′,9-triethyl-5,5′-diphenyloxacarbocyanine bromide and anhydro-5,5′,6,6′-tetrachloro-1,1′,3-triethyl-3′-(3-sulfobutyl)-benzimidazolocarbocyanine hydroxide as spectral sensitizers adsorbed on the surface thereof, and from 10 to 90 percent, by weight, based on total silver halide present, of monodispersed reflecting silver halide grains free of surface spectral sensitization and having a particle size greater than 0.40 microns and less than 0.60 micron in diameter, said reflecting silver halide grains free of surface spectral sensitization being intimately admixed with said silver bromoiodide grains including spectral sensitizers adsorbed on the surface thereof which reflecting grains, upon exposure, cause electromagnetic radiation to impact upon the surface of the spectrally sensitized silver bromoidodide grains.

* * * * *